US006556110B1

(12) United States Patent
Niebler et al.

(10) Patent No.: US 6,556,110 B1
(45) Date of Patent: Apr. 29, 2003

(54) SWITCHING DEVICE WITH INTERRUPTER CHAMBER MODULE

(75) Inventors: Ludwig Niebler, Laaber (DE); Michael Strassburger, Ensdorf (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/673,869

(22) PCT Filed: Apr. 14, 1999

(86) PCT No.: PCT/DE99/01116

§ 371 (c)(1),
(2), (4) Date: Dec. 13, 2000

(87) PCT Pub. No.: WO99/54897

PCT Pub. Date: Oct. 28, 1999

(30) Foreign Application Priority Data

Apr. 22, 1998 (DE) ..... 198 18 058

(51) Int. Cl.[7] ..... H01H 67/02

(52) U.S. Cl. ..... 335/133; 335/127; 335/132; 200/245; 200/246; 200/247

(58) Field of Search ..... 200/245, 246, 200/247, 271, 272; 335/127, 129, 130, 135, 132–134

(56) References Cited

U.S. PATENT DOCUMENTS

| | | | | |
|---|---|---|---|---|
| 3,436,497 | A | 4/1969 | Mading | |
| 4,684,772 | A | 8/1987 | Lehman | 200/306 |
| 5,075,517 | A | 12/1991 | Spanio | 200/16 A |
| 5,635,886 | A | 6/1997 | Pichard | 335/132 |

FOREIGN PATENT DOCUMENTS

| | | |
|---|---|---|
| DE | 1 230 893 | 12/1966 |
| DE | 34 46 870 | 7/1986 |
| DE | 693 02 599 | 9/1996 |
| EP | 0 049 550 | 4/1982 |

*Primary Examiner*—Ramon M Barrera
(74) *Attorney, Agent, or Firm*—White & Case LLP

(57) ABSTRACT

An arcing chamber assembly is described having two side walls, a contact compression spring, a contact link, a slide which can be mounted one behind the other in the interior of the arcing chamber assembly, just by stacking them from one side. For this purpose, the arcing chamber assembly includes a passage, whose length is at least equal to the length of the contact link on the component supply side.

9 Claims, 3 Drawing Sheets

SWITCHING DEVICE WITH INTERRUPTER CHAMBER MODULE

FIELD OF THE INVENTION

The present invention relates to a switching device having an arcing chamber assembly with two opposite, elongated side walls by means of which an internal area is formed in which a slide is mounted such that it can move in a movement direction transversely with respect to the longitudinal extent of the arcing chamber assembly, with a moving contact link, which is associated with fixed contacts, being held in an opening in the slide under the influence of a contact compression spring.

BACKGROUND INFORMATION

A switching device of this generic type is described in German Patent No. DE 693 02 599. This patent describes a multipole switch disconnector in which an isolating structure having disconnectable contacts is provided for each pole current path. Each pole current path contains two fixed contacts and two moving contacts arranged on a moving contact link, thus forming a double-interruption pole switch. A mechanism for opening and closing the contents acts on the moving contact link. This is done via a trigger, which is guided in a fixed cage. The cage is composed of insulating material and contains a base wall and side walls projecting from it at right angles, and is provided with windows whose sizes are such that they allow the movement of the contact link, in particular under the influence of the opening and closing mechanism, when an electrodynamic reaction occurs. Furthermore, the windows define an upper stop for the contact link. A contact compression frame is arranged in a central hollow of the cage, between the base wall of the cage and the contact link, and this hollow acts as a seat and a translational guide for the trigger. The trigger is thus guided against the inner surfaces of the side walls of the cage. The walls of the trigger have openings, whose sizes are such that, on the one hand, they allow the contact link to be inserted into the trigger and, on the other hand, allow angular movement of the link with respect to the trigger. The cage contains isolating vanes, which run in the longitudinal direction over a distance which is somewhat greater than the length of the contact link, and whose height is sufficient to produce a volume which contains the opening arcs.

This arcing chamber assembly is assembled in such a way that the trigger and slide are first introduced into the cage, and are then held in a defined position. In consequence, a window in the slide is accessible from the side under the webs which form the stops. Once the contact compression spring has been inserted from above through the hole in the slide into the cage, the moving switching piece is inserted into the space which is still free in the window, after compressing the spring by means of a stamp, and is finally rotated to its final operating position by rotating it through 90°.

The described assembly process is time-consuming and costly.

SUMMARY

An object of the present invention is to improve a switching device of the abovementioned type, having an arcing chamber assembly, which allows simple, in particular automated, assembly.

This object is achieved in that a passage whose length is at least equal to the length of the contact link is provided from the internal area to the exterior between the opposite longitudinal sides of the two side walls, through which passage the contact link can be inserted into the internal area in order to be held between the contact compression spring and the slide.

The example embodiment according to the present invention offers the advantage that those parts which are located in the arcing chamber assembly can be fitted into the internal area successively, in a movement direction from one side. The passage provides sufficient free space to allow assembly easily by means of industrial robots.

In an advantageous development of the present invention, the side walls have a stop for the slide.

It is also advantageous if the slide can be latched to the side walls, in order to create a simple connection in this way.

The slide advantageously has latching elements which engage in slots formed parallel to the movement direction of the slide. This means that there is a loose latched connection between the slide and the side walls, which allows the slide to move in the said movement direction.

If the two side walls are connected only on two opposite longitudinal sides by means of an arcing chamber base on which the contact compression spring is supported, this results in an embodiment in which the heat which is produced by the arcs in the internal area is dissipated well.

Owing to the arcing heat, the structure together with the two side walls can be distorted and deformed unacceptably. In order to avoid this, the arcing chamber assembly is advantageously embedded in the chamber system in such a way that the side walls are supported on the outside.

A further advantageous measure is provided by ribs on one housing part and/or on other subassemblies of the switching device, which project into the arcing chamber and thus ensure a spacing from the side walls.

DETAILED DESCRIPTION

Figure 1:
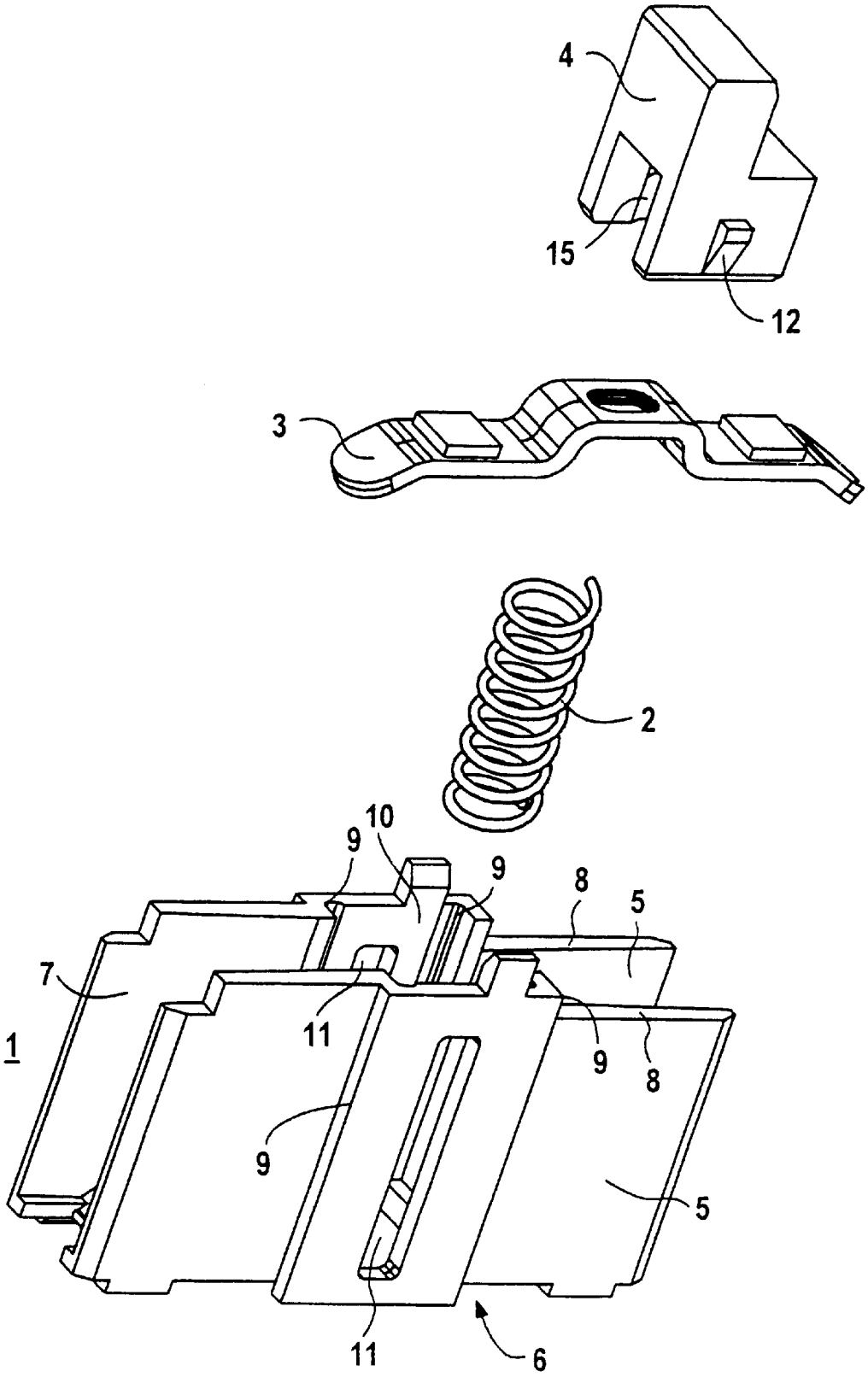
FIG. 1 shows an exploded view of the arcing chamber assembly according to the present invention, together with the associated components.

FIG. 1 shows an exploded view of an arcing chamber assembly 1, a contact compression spring 2, a moving contact link 3, and a slide 4 which may be referred to as a trigger. In the illustrated view, the arcing chamber assembly 1 includes two parallel, elongated side walls 5, which are connected on their underneath by means of an arcing chamber base 6, which is not shown here. The space 7 between the two side walls 5, that is to say the internal area, is accessible on all sides except for the connection through the arcing chamber base 6. A guide channel 10, which is provided with slots 11 in the side walls 5, is formed by means of contours 9 in the side walls 5, centrally and transversely with respect to the longitudinal sides 8. Once the contact compression spring 2 has been inserted into this guide channel 10 and is supported on the arcing chamber base 6, the moving contact link 3 is likewise inserted from above into the internal area. The dimensions of the guide channel 10 are matched to those of the slide 4. Once the moving contact link 3 has been inserted, the slide 4 is inserted into the guide channel 10, in the process, its latching tabs 12 arranged at the side latch in said slots 11 and comes to rest on the contact link. For this purpose, the slide 4 has an opening 15, which is in the form of a recess on the underneath in order to accommodate the contact link 3. The upper boundary of the slots 11 is in this case used as a stop 18 for the slide 4.

Figure 2:
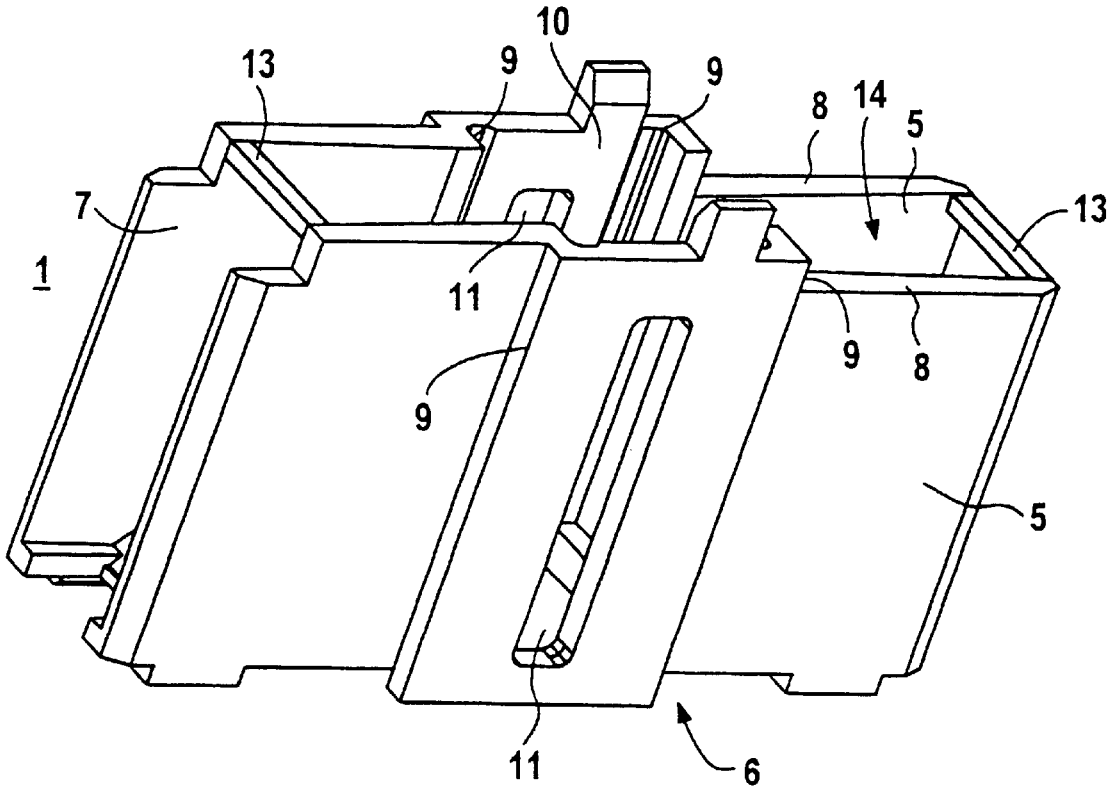
FIG. 2 shows an arcing chamber assembly modified from that in FIG. 1.

The arcing chamber assembly 1 may also be designed, for example, in such a way that the upper longitudinal sides 8, via which the components are inserted, are connected to one another by means of webs 13 as shown in FIG. 2. These webs 13 must be spaced apart so that a passage 14 whose length is at least equal to the length of the contact link 3 is formed between them. Accordingly, it is necessary to ensure that the entire length of the contact link 3 can be fed from above, in only one movement direction, into its final installed position in the internal area 7.

Figure 3:
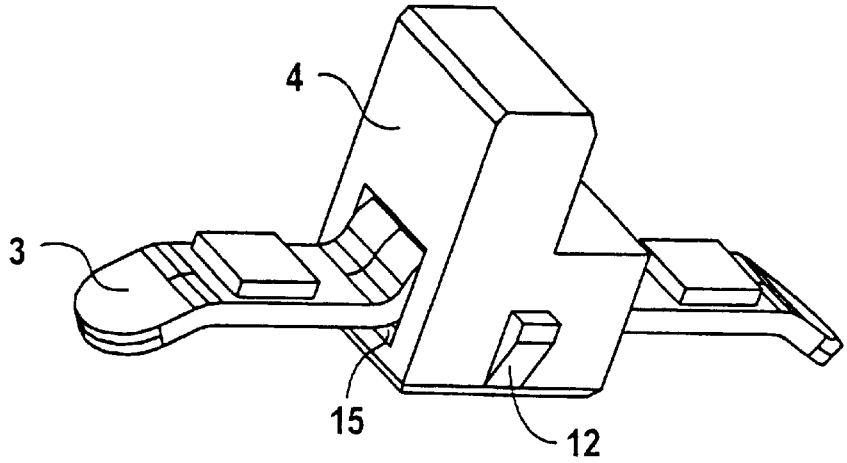
FIG. 3 shows a slide having a moving contact link.

FIG. 3 shows an alternative embodiment of a slide 4, in which the opening 15 is in the form of a window.

Figure 4:
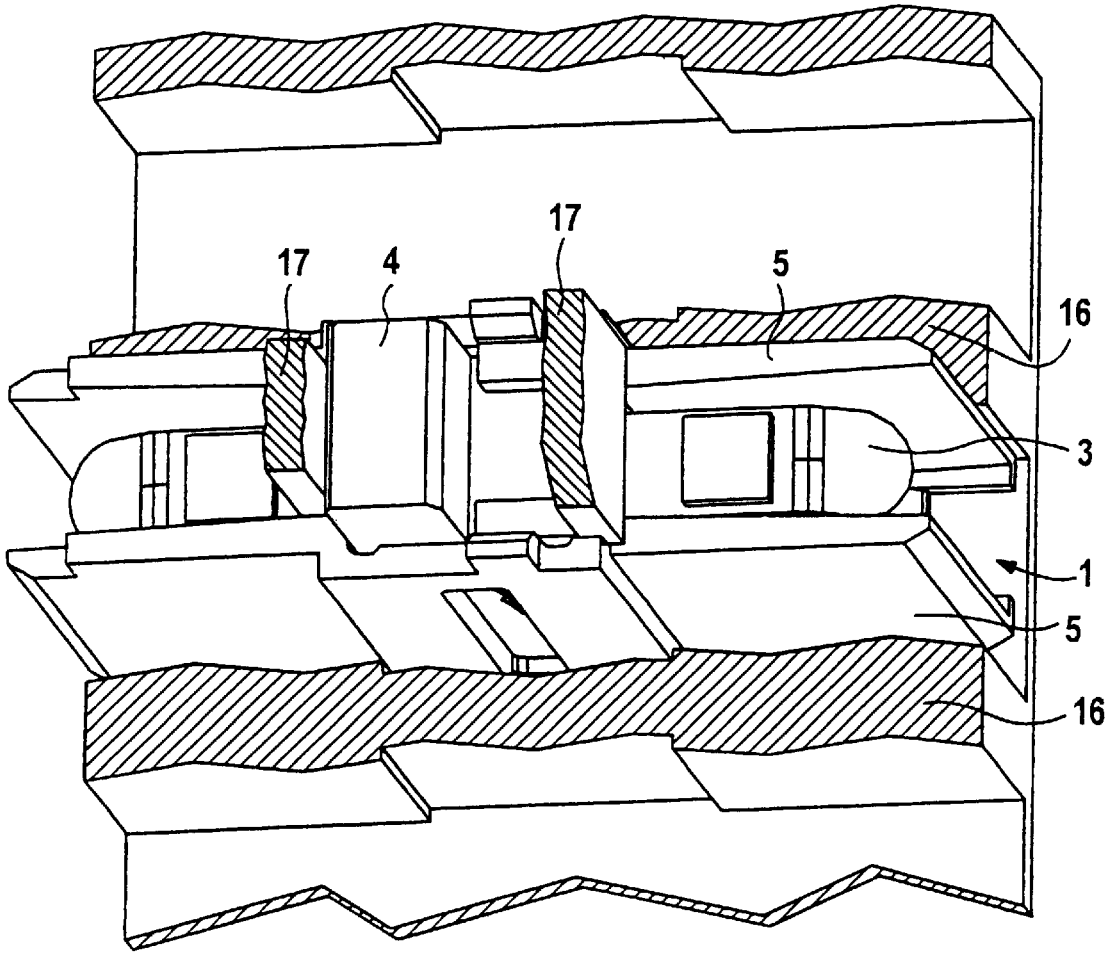
FIG. 4 shows an arcing chamber assembly embedded in a chamber system.

FIG. 4 shows how the assembled arcing chamber assembly 1 is embedded between the side walls 16 of a chamber system in a switching device. This results in the side walls 5 of the arcing chamber assembly 1 being supported on the outside so that they cannot be forced apart from one another. Furthermore, FIG. 4 shows transverse ribs 17, for example on another housing part or a subassembly, which project from above into the arcing chamber assembly 1 and spread the latter apart, that is say they ensure that there is a uniform minimum spacing between its side walls 5.

What is claimed is:

1. A switching device, comprising:

an arcing chamber assembly having two opposite side walls, the two opposite side walls forming an internal area;

a moveable slide mounted in the internal area for motion, when in operation, along an axis;

a contact compression spring disposed in the internal area for compression along the axis of motion of the slide;

a moving contact link associated with fixed contacts, the contact link being held in an opening in the slide using the contact compression spring, the contact link being fed through a passage from above along the axis of motion of the slide into the internal area so that the contact link is held between the compression spring and the slide, the passage extending from the internal area between the two opposite walls to an exterior and having a length at least equal to a length of the contact link.

2. The switching device according to claim 1, wherein the side walls include a stop for the slide.

3. The switching device according to claim 1, wherein the slide is latchable to the side walls.

4. The switching device according to claim 1, wherein the slide includes latching elements which engage in slots formed parallel to a movement direction of the slide.

5. The switching device according to claim 1, wherein the side walls are connected only on two opposite longitudinal sides using an arcing chamber base on which the contact pressure spring is supported.

6. The switching device according to claim 5, further comprising at least one web disposed between the opposite side walls.

7. The switching device according to claim 6, wherein the at least one web comprises a pair of webs spaced from each other at a distance at least equal to the length of the contact link, to permit the entire length of the contact link to be fed from above in only one movement direction.

8. The switching device according to claim 1, further comprising:

a chamber system, the arcing chamber assembly being embedded in the chamber system so that the side walls are supported on the outside.

9. The switching device according to claim 1, further comprising:

ribs on at least one of a housing part and a subassembly of the switching device projecting into the arcing chamber assembly to ensure a permanent spacing from the side walls.

* * * * *